US011603308B2

(12) United States Patent
Sever

(10) Patent No.: US 11,603,308 B2
(45) Date of Patent: Mar. 14, 2023

(54) COMBINED NOZZLE AND FLOAT CONTROLLED NOZZLE VALVE FOR GRADUAL DELIVERY OF FUEL TO A FUEL TANK

(71) Applicant: John C. Sever, Villa Ridge, MO (US)

(72) Inventor: John C. Sever, Villa Ridge, MO (US)

( * ) Notice: Subject to any disclaimer, the term of this patent is extended or adjusted under 35 U.S.C. 154(b) by 0 days.

(21) Appl. No.: 17/803,130

(22) Filed: Feb. 25, 2022

(65) Prior Publication Data

US 2022/0274825 A1 Sep. 1, 2022

Related U.S. Application Data

(60) Provisional application No. 63/207,452, filed on Mar. 1, 2021.

(51) Int. Cl.
*B67D 7/36* (2010.01)
*B67D 7/04* (2010.01)

(52) U.S. Cl.
CPC ..... *B67D 7/365* (2013.01); *B67D 7/04* (2013.01)

(58) Field of Classification Search
CPC ..... F16K 31/22; F16K 24/044; B67D 7/04; B67D 7/365
USPC ..... 137/15.26, 135, 409
See application file for complete search history.

(56) References Cited

U.S. PATENT DOCUMENTS 1,396,655 A 11/1921 Newton
1,442,168 A 1/1923 Metzger
2,299,360 A * 10/1942 Tharp ..... F16K 31/24 137/448
2,464,456 A * 3/1949 McGillis ..... B67D 7/365 137/421
2,580,057 A 12/1951 Wilhelm
2,651,200 A 9/1953 Colbum
4,064,907 A * 12/1977 Billington ..... F17C 13/021 137/446
4,313,459 A * 2/1982 Mylander ..... F17C 13/04 137/433
4,526,033 A 7/1985 Flider
4,635,480 A * 1/1987 Hrncir ..... G01F 23/34 73/317
4,986,320 A * 1/1991 Kesterman ..... B67D 7/365 137/445
5,006,834 A 4/1991 Fountain
(Continued)

*Primary Examiner* — Timothy L Maust
(74) *Attorney, Agent, or Firm* — Sandberg Phoenix & von Gontard PC

(57) ABSTRACT

A float controlled nozzle valve for use in a fuel nozzle, to provide for gradual delivery of fuel to a fuel tank, the nozzle, having a housing, including a generally horizontally arranged spout, and embodying a float rod and float assembly, which act upon a valve provided within the nozzle housing, to detect and provide for the flow of fuel into an associated fuel tank, or to curtail the same. The float rod pivotally mounts within the nozzle housing, contains an adjustment screw, which can bias against a valve pin to determine when a valve ball is to be opened from its valve seat, to allow the passage of fuel, or when the valve ball is allowed to seat upon its valve seat, to curtail the further flow of fuel. The nozzle housing is provided for securement to the fuel tank, for which it detects the level of fuel within the tank, to determine when an additional supply of fuel is to be dispensed by way of the nozzle, into its associated fuel tank.

9 Claims, 2 Drawing Sheets

(56) References Cited

U.S. PATENT DOCUMENTS

| | | | | |
|---|---|---|---|---|
| 5,080,126 | A * | 1/1992 | De Rycke | F16T 1/24 137/445 |
| 5,174,345 | A * | 12/1992 | Kesterman | F16K 31/18 137/445 |
| 6,536,465 | B2 * | 3/2003 | David | F16K 21/18 137/442 |
| 6,874,528 | B2 * | 4/2005 | Kozik | F16K 1/385 137/446 |
| 7,174,912 | B2 * | 2/2007 | Lowe | E03C 1/052 137/434 |
| 8,256,451 | B2 * | 9/2012 | Frederiksen | F17C 13/021 137/445 |
| 9,463,971 | B2 * | 10/2016 | Higgins | F16K 31/20 |
| 10,801,874 | B2 | 10/2020 | Nilsen et al. | |

* cited by examiner

COMBINED NOZZLE AND FLOAT CONTROLLED NOZZLE VALVE FOR GRADUAL DELIVERY OF FUEL TO A FUEL TANK

CROSS REFERENCE TO RELATED APPLICATIONS

This is a nonprovisional patent application that claims priority to the provisional patent application having Ser. No. 63/207,452, filed on Mar. 1, 2021.

FIELD OF THE INVENTION

This invention relates to the delivery and maintenance of fuel supplied to a fuel tank, as one that may supply fuel to the oil industry, such as a fracking truck, or to any other fuel collecting facility that requires the continuous monitoring and delivery of fuel to its fuel tank, to assure that an adequate supply of fuel is always available to the mechanisms that it operates. More specifically, this invention relates to a combined float controlled nozzle valve within a nozzle that provides for the gradual delivery of fuel to a fuel tank, to assure that it is always maintained approximately full, during its usefulness in supplying fuel to fuel consuming instruments, engines, generators, heaters, and related mechanisms.

BACKGROUND OF THE INVENTION

This invention relates to the continuous gradual supply of fuel to a fuel tank, through usage of a float controlled nozzle valve, that can continuously monitor and deliver fuel to the fuel tank, to assure that it has adequate supply for delivery to and usage in the operation of other components, such as a fracking truck in the oil industry.

By way of background, and to explain the need for the current invention, for example, in the fracking industry there is a necessity that the fracking vehicle used in the process of extracting residue oil from underground, is a reasonably delicate operation, subject to the generation of very high pressures, at the truck site, and which pressures of the fracking fluids, used in hydraulic fracturing, usually includes a mixture of water, a proppant, and various chemical additives. Proppants usually are microparticles that keep the microfractures underground, open during and after the fracking process. Sand is commonly used for this purpose. But, the entire operation is done under significant pressures, and thus, the dangers that can occur at ground level, particularly around the fracking truck, do exist. Furthermore, once a fracking operation has commenced, it must continue continuously, 24-7, throughout the entire life of the fracking process, which may take weeks, to perform, to maintain any high degree of efficiency. For example, fracking in a well may extend deep into the ground surface, perhaps many thousands of feet, and then the horizontal segment of the bore can extend up to six thousand feet or more, away from the vertical part of the well, in order to achieve access to that captured petroleum, which is released, under such pressures, for delivery to the surface, and its collection. Thus, as can be readily understood, to continue the fracking process almost indefinitely, requires a continuous supply of fuel that operates the fracking truck, or its related components, continuously, and such fuel when delivered to the fuel tank of the truck, must be monitored continuously, to make sure that the fuel level in the tank remains full, and does not reach a low red level, indicative of a dangerous low level of fuel within the fuel tank, all to assure that adequate supply of fuel is always available, to allow for this continuous operation, of fracking.

For further background information, the nozzle of this invention has been designed principally for use in the oil fracking business. As stated, fracking is done by parking a number of vehicles, known as frack trucks equipped with fracking equipment, and through the work of fracking for several weeks in a row is performed without moving from the location where they are parked. It is necessary that these vehicles be continuously supplied with fuel and diesel exhaust fluid for the entire time they are operating. This current nozzle provides a method of supplying these fluids with a minimum of human contact with the fuel supply and the vehicles, which as previously stated, are the fracking trucks, while in operation, which are not typically considered to be safe to approach while in use, and especially while under pressure.

Obviously, there are many float type valve means that are used to indicate the amount of fuel left within a fuel tank.

There are a variety of mechanical type tank gauge devices, that are purely mechanical, as distinct from those that are either electronically operated, or utilize electrical sensors, and such are available in the prior art. One such gauge can be seen in U.S. Pat. No. 4,526,033, upon a fuel gauge for safety and waste disposal drums.

U.S. Pat. No. 10,801,874, shows a fully adjustable liquid tank float.

An early tank gauge can be seen in the patent to Colburn, U.S. Pat. No. 2,651,200. A gasoline gauge, using a float, can be seen in U.S. Pat. No. 1,442,168. A related type of gauge can be seen in the early U.S. Pat. No. 1,396,655. Another liquid level alarm is noted in U.S. Pat. No. 5,006,834. A float gauge can be seen in U.S. Pat. No. 2,580,057. These are examples of early mechanical type of float indicating devices, for use with liquid containers.

The current invention incorporates the feature of a combination of a fuel dispensing nozzle, integrated with a float device, and provides for a gradual, not high flow, delivery of liquid to a fuel storage tank, to assure that a constant supply of fuel is readily available for the continuous operations of the machinery to which the fuel is delivered.

These are just examples of what is known in the prior art.

SUMMARY OF THE INVENTION

This invention generally relates to a fuel dispensing nozzle, and one that is used in conjunction with a fuel tank, that must be maintained at full capacity, to furnish fuel to continuously operating mechanisms, primarily in the oil fracking business, to assure that an adequate supply of fuel is readily available for a long duration, to maintain the continuous operations of such equipment.

The invention essentially includes a nozzle, incorporating a housing, having a valve located therein, and which valve can be opened or closed depending upon the location of an associated float rod and float assembly, the assembly riding upon the surface of any fuel located within the associated fuel tank, during its operations. The float rod, at its front end, engages with the float assembly, and at its back end, pivotally mounts within a nozzle housing, that further includes the various valving mechanisms, such as the ball valve and its valve seat, and various valve pins, responsive to the location of a valve stem, that is adjustably connected with the approximate back end of the float rod, such that when the float assembly elevates, it will allow for closure of the ball valve, and curtail any further flow of fuel into the fuel tank, but that when the float assembly lowers, due to consumption of fuel, the adjustable valve stem allows for a forced opening of the ball valve of the valve assembly, to allow for the gradual flow of fuel into the fuel tank, to replenish its capacity. The nozzle housing threadedly engages at one end, for connection with the intake fuel flow line, while its opposite end incorporates a spout, through which the float rod extends, further incorporates a coupling, for its securement to the nozzle spout, and also to the fuel tank, to which it replenishes its fuel supply, continuously, to allow for long term operations of the various machinery or equipment that relies for their operations upon the fuel supplied and remaining in the fuel tank, during their continuous functioning.

The float controlled nozzle valve includes the nozzle, the float assembly, a float rod, that vertically shifts depending upon the amount of fuel within the fuel tank, as detected by the buoyant float assembly. The nozzle does include its nozzle housing, incorporates a nozzle valve, the valve includes a ball valve and valve seat, the ball valve normally being biased into closure upon its seat by means of a spring, and the valve further includes at least one valve pin, responsive to a valve stem that is operatively associated with the float rod, and subject to shifting in response to the pivoting of said float rod during the rise or lowering of its associated float assembly, during usage. The valve stem is adjustable, to determine the length of time that the valve remains opened, to fill said fuel tank in response to the location of the float rod and said associated float assembly.

Generally, the flow path for fuel through the nozzle valve is of narrow dimensions, so that even when the nozzle valve is opened, the flow of fuel through the nozzle, and into the fuel tank is of a gradual flow rate, somewhere in the range of 2-10 gallons per hour and preferably around approximately five gallons per hour during application.

In its operations, pressurized fuel or diesel exhaust fluid (DEF) enters the nozzle via its threaded inlet, through the attachment of a fuel delivery hose or similar apparatus that can be connected to the inlet, while the fuel hose in turn is connected to a supply of either fuel, or DEF, which may be equipped with a pump to supply pressure and fluid flow to the DEF or fuel, for delivery to the associated fuel tank.

Following the path of the fuel or DEF from the inlet of the nozzle housing, the fuel encounters the nozzle valve, which provides a passageway through it, but is restricted by a ball valve, that normally seats upon its valve seat, to maintain the flow path in closure. This ball valve either opens the passageway to the flow of liquid, or closes it, depending upon the conditions of the associated float assembly, and its pivotal float rod, as noted. As the float assembly is elevated, typically by the presence of fuel or DEF at a full capacity within the fuel tank, the valve ball will close the valve, which occurs both by the liquid pressure, and the valve spring that biases against the ball valve, that urges it against its valve seat, to provide for closure of the nozzle valve. If the float assembly is not elevated, then the float rod pivots lower, which allows for the movement of the valve stem that is operatively associated with the float rod, thereby pushing the ball valve away from its seat upon the valve, to allow for the gradual or almost trickle flow of fuel through the nozzle valve, and into the fuel tank to attain, eventually, its full capacity.

In the preferred embodiment, the valve stem includes an adjustment screw, and is provided so that the exact amount of elevation required to close the valve can be adjusted, as desired, in order to achieve that full fuel flow into the fuel tank, during operations.

The nozzle spout, of the nozzle housing, inserts into the appropriate and associated fuel or DEF tank, and is secured therewith, while the inlet end of the nozzle housing incorporates the inlet threads, that does connect to the supply line carrying the liquid DEF or fuel, as described. The ball valve will open or close depending upon the liquid level inside the fuel tank. A tank with a lower level of fuel or DEF will result in an opened valve, which in turn will fill that tank until the liquid level has risen enough to elevate the float assembly, and again close the nozzle valve, after a fill condition has been achieved. The valve will open again, when the liquid level has decreased sufficiently within the fuel tank, thus the combination of the float assembly, and the nozzle valve, provides a continuous supply of such fuels to the fuel tank, to provide for the type of continuous operations as previously explained.

The float assembly is generally designed to pivot approximately a few degrees, around 10°, so that when it is elevated to the upper limit, curtails the further flow of fuel into the fuel tank, but that when the float assembly lowers, approximately that 10°, will open up the nozzle valve, to continue the further flow of fuel through the associated nozzle and into the associated tank, such as of the fracking trucks.

It is, therefore, the principal object of this invention to provide a fuel dispensing nozzle, having inherent float structure, for automatically determining when the nozzle is to be opened, to dispense fuel into an associated fuel tank, or when the nozzle valve is to be closed, to curtail any further flow of fuel into the said tank.

A further object of this invention is to provide a nozzle valve, located within a nozzle housing, and which provides for a much lower capacity and rate of fuel flow, so as to gradually fill a fuel tank, to full capacity, and to shut off the delivery of such fuel, when such capacity has been gradually attained.

A further object of this invention is to provide the combination of a valve mechanisms, within a fuel dispensing nozzle, which are operatively associated with a float assembly, for determining when a gradual flow of fuel needs to be supplied into an associated fuel tank, or to curtail such fuel flow, when a tank at full capacity, or near full capacity, has been determined.

Yet another object of this invention is to provide for the fine adjustment of a nozzle valve, within a nozzle, through adjusting its associated valve stem, for determining when the nozzle is to initiate fuel flow, or to curtail the same, when a full capacity of fuel within the tank is detected.

Yet another object of this invention is to provide a miniscule fuel flow path through the associated nozzle valve, of the nozzle housing, so that a much slower delivery of fuel into a fuel tank, can be maintained.

These and other objects may become more apparent to those skilled in the art upon review of the Summary of the Invention as provided herein, and upon undertaking a study of the Description of its Preferred Embodiments, in view of the drawings.

DESCRIPTION OF THE PREFERRED EMBODIMENTS

Figure 1:
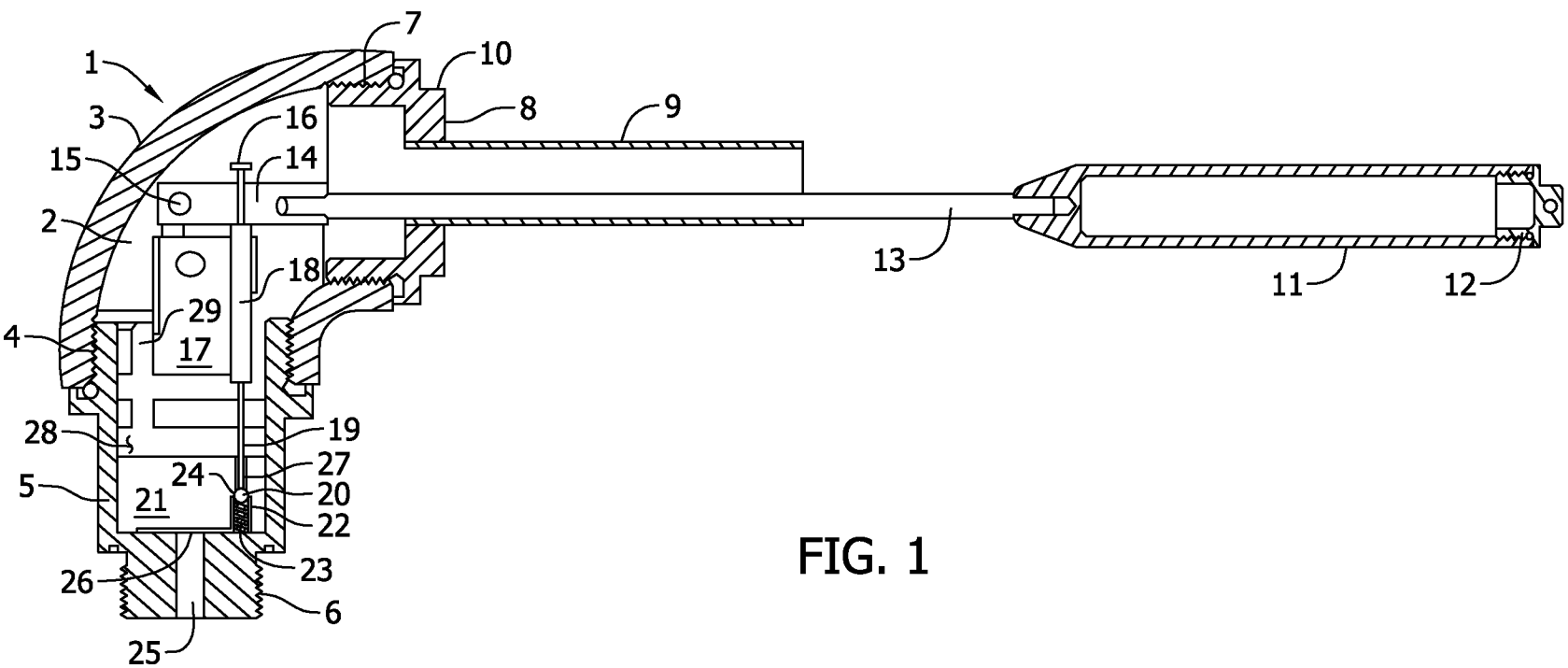
FIG. 1 is a sectional view of the float controlled nozzle valve for use in combination in a fuel nozzle disclosing its nozzle housing, spout, and float assembly, for the furnishing for the gradual delivery of fuel to a fuel tank.

In referring to the drawings, the depiction of this invention, as shown in cross-section, discloses the nozzle 1 comprising a nozzle housing 2, as noted, and through which fuel flows, when delivering the combustible fuel, or the diesel exhaust fluid (DEF), to a fuel tank (not shown), to which this nozzle is applied. As noted, the nozzle includes an elbow 3 which is threaded at its lower end, as at 4, and to which a fitting 5 threadedly engages, the fitting, plus the elbow, holding the valve components of this nozzle as can be seen. The bottom end of the fitting is also threaded, as at 6, and it is through this fitting that the incoming fuel flow line connects, for delivering the types of fuels as described to the nozzle for discharge into the associated fuel tank, as explained.

The upper end of the elbow 3 is also threaded, as at 7, and an adaptor, as at 8, threadedly engages therein, and the adaptor has connected therewith a nozzle spout 9, as noted. The adaptor 8 may likewise have threads (not shown), at the region of 10, and which allow for the entire nozzle to be engaged with the fuel tank, when installed.

Outwardly of the nozzle is the float assembly 11, which has, obviously, captured air, through connection of its end cap 12, and which assembly is designed to float upon the surface of any fuel provided within the fuel tank, and provide for gauging the level of fuel remaining within the tank, during usage of this nozzle, and its various delivering components, as noted. Connecting with the float assembly is a float rod 13, and the float rod, within the nozzle housing 3, connects with a rod extension 14, and the extension pivotally connects within the nozzle housing by means of a pivot pin 15 approximate its back end thereof.

Extending through the extension 14 is a valve stem 16, this valve stem being an adjustment screw that threadedly engages through the extension 14, so that this adjustment screw can be extended upwardly, or downwardly, relative thereto, to control the operations of the float assembly, and to initiate the operations of the nozzle valve components, as noted at 17, during its operations. The adjustment screw 16 biases on top of a vertically oriented valve pin 18, and that valve pin is connected with an additional valve pin 19, which contacts and pressures at its lower end against a ball valve 20, as can be seen. This portion of the nozzle valve, as at 21, has a narrow sized flow path 22 provided therethrough, and locates a spring 23 that normally biases the ball valve against the valve seat 24, into closure, to prohibit the flow of fuel. But, when the float assembly lowers, and thereby lowers the associated adjustment screw 16, through the downward pivot of the float rod and its extension 14, this biases the additional valve pin 19 against the ball valve 20, forcing it off of its valve seat, to thereby allow for the flow of fuel through the nozzle, out of its spout 9, to gradually replenish the fuel within the associated fuel tank, as explained.

It can be seen that there is a fuel flow path 25 that communicates with a fuel path 26, which communicates with the valve flow path 22, and the narrow passage 27 thereby allowing the flow of fuel to pass into the channels 28, 29 and into the nozzle housing 2, for flow through the spout 9, to allow the flow of fuel into the fuel storage tank, as described.

Hence, as can be readily understood, when the float assembly is raised, due to full fuel, the spring 23 biases the ball valve 20 against its valve seat 24, and prevents the further flow of intake fuel, through the nozzle valve assembly. But, when the float assembly pivots downwardly, as shown in the figure, this pressures the adjust screw 16 against the valve pin 18, it lowers the valve pin 19, forcing the ball valve 20 to disengage from its valve seat 24, to allow for the gradual flow of fuel through the nozzle housing, and into the fuel tank, until such time as the tank fills, and elevates the float assembly, thereby shutting off the ball valve against its valve seat, and to prevent the further intake of fuel through the nozzle, discontinuing any further supply of fuel into the storage tank, once a full predetermined capacity, i.e. full or near full capacity, has been detected.

As can be noted, the various passages, such as noted at 22, the narrow passage of 27, the flow passages at 28 and 29, are all of small dimensions, which means that the flow of fuel through the nozzle is of a low rate, thereby only gradually delivering fuel to the fuel tank, at a rate of approximately five gallons per hour, as previously explained. This not only makes the filling of the tank of a more gradual process, but it lessens the potential for the occurrence of any hazard, during operations of any associated mechanism, such as the fracking instrument and its truck, to prevent any accidents, as can occur in the oil fracking industry.

Furthermore, for the type of nozzle as explained, it can be used for filling other types of fuel tanks, such as one that may be associated with a generator, or any other instrument that operates off a combustible fuel, to provide a continuous supply of gasoline, or any other type of diesel fuel, that may be needed to sustain the operations of associated mechanisms, such as internal combustion engines, during their continuous operations.

Figure 2:
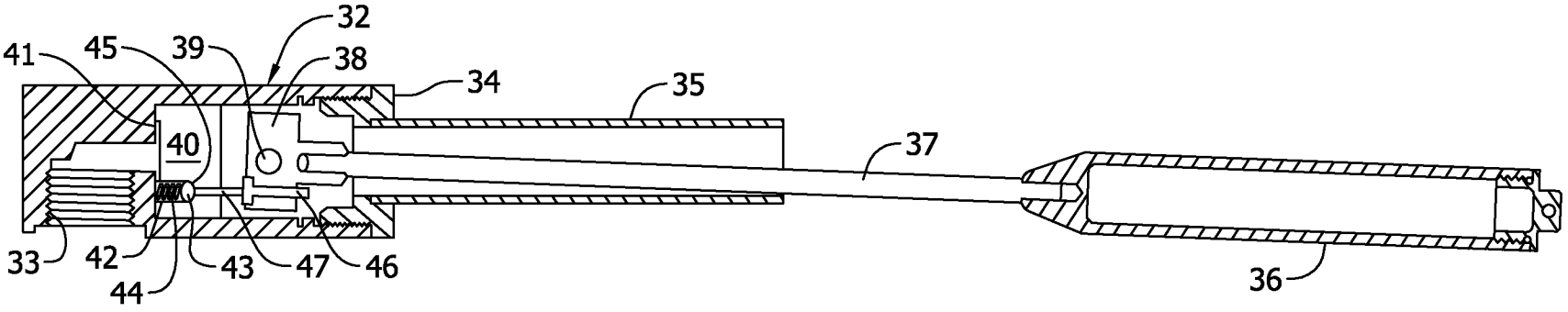
FIG. 2. shows a modification to the embodiment of the float controlled nozzle valve, and nozzle, for this invention.

A modification to the float controlled nozzle valve for use in a fuel nozzle can be seen in FIG. 2. In this particular embodiment, the valve components are arranged more on a horizontal position, relative to the nozzle housing and its spout, in order to condense the size of the nozzle, through its installation. As can be seen, the nozzle housing 32 includes a threaded inlet, as at 33, to which the incoming fuel line can be applied, to deliver fuel to the nozzle for further controlled flow into a fuel tank, of the type as previously described. The housing has its adaptor 34 threadedly engaged to its outlet end, and which further holds the spout 35 generally horizontally disposed as can be noted. This adaptor 34 may engage with the fuel tank for installation of the nozzle and into housing thereto. The float assembly 36 is applied to the end of the float rod 37, and the opposite end of the float rod is secured to a pivot mount 38 that pivots about its pin 39, as noted.

The valve 40 includes a fluid passage 41, that communicates with a valve chamber 42, and holds a valve ball 43, and a spring 44, that normally biases the ball valve against its valve seat 45, as can be seen. There is a valve stem 46 threadedly engaged within the pivot mount 38, threadedly engaged to provide for its adjustment, as an adjustment screw, that cooperates with a valve pin 47 that provides for opening or closing of the valve ball 45, within the valve 40, depending upon the location of the float assembly, and its pivotal float rod, with respect to the quantity of fuel remaining within the fuel tank for which this nozzle replenishes fuel as required. When the float assembly is elevated within the fuel tank, because of a full capacity of fuel, the valve 40 remains closed, and does not allow the passage of any fuel through it, under those circumstances. But, when the fuel is being consumed, and the float assembly lowers, the pivot stem 46 biases against the valve pin 47, pushing the valve ball 45 off of its valve seat, and thereby allowing for almost a trickle flow of fuel through the passage 42, around the valve pin 47, and into the housing, for passage through the spout 35, and into the fuel tank, to replenish its quantity of fuel. As previously stated, this is accomplished generally at a low flow rate, so as to not disrupt the amount of fuel contained within the tank, or to cause an overfilling, which can lead toward some hazardous results, as previously reviewed.

As can be seen, when the float assembly and its rod 37 are pivoted, within the spout, there is an approximate 10° range of pivot, between an open position for the valve, and a closed position for the valve, as when the float assembly is pivoted upwardly, upon the surface of the replenished fuel contained within the fuel tank, after a filling thereof.

Variations and modifications to the subject matter of this invention may occur to those skilled in the art upon review of the invention as described herein. Such variations, if within the spirit of this invention, are intended to be encompassed within the scope of any claims to patent protection issuing upon this invention. The summarization of the invention, and its depiction in the drawings, are generally set forth for illustrative purposes only.

I claim:

1. A float controlled nozzle valve for use in a fuel nozzle for gradual delivery of fuel to a fuel tank, comprising:

a nozzle, said nozzle having a generally horizontally arranged spout when in usage;

a float assembly, a float rod securing to said float assembly, said float rod extending into said nozzle spout and pivotally mounted within said nozzle for vertically shifting relative to said nozzle;

said float assembly provided for buoyantly floating upon the fuel provided within said fuel tank and determining when additional fuel is to be gradually delivered to said fuel tank when said float assembly is lowered due to a low fuel level, or when delivery of fuel is to be curtailed due to a fill capacity of said fuel has been delivered to the fuel tank thereby causing the said float assembly to elevate and shut off the further delivery of fuel to the fuel tank;

said nozzle including a nozzle housing, a valve provided within said nozzle housing, said valve including a valve stem and said valve stem operatively associated with said float rod and subject to shifting in response to the pivoting of the said float rod and its vertical shifting in response to the pivoting of the said float rod and the associated float assembly;

said valve stem being adjustable to determine the duration the valve remains opened to fill said fuel tank in response to the location of the float rod and the said associated float assembly; and wherein said valve provides a miniscule flow there through, said valve having a valve seat, a ball valve provided within said flow path within the valve wherein said ball valve seats upon its valve seat to curtail the delivery of fuel therethrough, when the float assembly is elevated in response to a full capacity of fuel provided within the fuel tank, a valve pin provided between said valve stem and ball valve to force said ball valve off of its valve seat to initiate flow of fuel into the fuel tank, and said valve stem in response to the location of the float rod and float assembly capable of being lowered, due to fuel consumption from the fuel tank, to thereby open the ball valve from its valve seat and to allow for the gradual flow of fuel through the valve, its associated nozzle, and out of the nozzle spout, to automatically gradually refill the amount of fuel within the fuel tank during its operations.

2. The float controlled nozzle valve of claim 1, wherein said valve stem is threadedly adjustable to the float rod and determines when the valve is opened or closed depending upon the location of the float assembly in response to the amount of fuel in the fuel tank during its operations.

3. The float controlled nozzle valve of claim 1, wherein the flow of fuel through to the nozzle and into a fuel tank is within the range of two to ten gallons of fuel per hour.

4. The float controlled nozzle valve of claim 3, wherein the flow of fuel through the valve and out of its nozzle and nozzle spout is approximately five gallons per hour.

5. The float controlled nozzle valve of claim 1, wherein said valve flow path, said ball valve, said valve pin, and the adjustable valve stem, are vertically arranged within the nozzle housing, with the valve stem being approximately vertically locating within the structure of the float rod where it pivotally connects within the nozzle housing.

6. The float controlled nozzle valve of claim 1, wherein said nozzle housing has an inlet through which fuel passes into said nozzle housing and which threadedly connects with an incoming fuel flow line during its assembly.

7. The float controlled nozzle valve of claim 6, and including a fitting provided at the outlet end of the nozzle housing, said nozzle housing having a fuel outlet at the nozzle spout, and said fitting connecting with the nozzle spout, with the fitting being threadedly engaged with the nozzle housing at its fuel outlet.

8. The float controlled nozzle valve of claim 1, wherein said valve flow path, its ball valve, the valve pin, and the adjustable valve stem, are vertically arranged within the nozzle housing with the valve stem being approximately vertically located within the structure of the float rod where it pivotally connects within the nozzle housing.

9. The float controlled nozzle valve of claim 1, wherein said float assembly is designed to pivot approximately 10 degrees, whereby in its upper limit, further flow of fuel into the fuel tank is restricted, such that as the float assembly lowers, up to approximately 10 degrees, the nozzle valve's restriction lessens to permit increased flow through the associated nozzle.

* * * * *